United States Patent [19]

Pedlar et al.

[11] 4,030,434

[45] June 21, 1977

[54] VEHICLES OF THE SUBMERSIBLE TYPE

[75] Inventors: Roy Pedlar; Alan Roderick Spencer; Colin Edwards, all of Bristol, England

[73] Assignee: British Aircraft Corporation Limited, London, England

[22] Filed: Mar. 10, 1976

[21] Appl. No.: 665,577

[30] Foreign Application Priority Data

Mar. 15, 1975 United Kingdom ..... 10916/75

[52] U.S. Cl. ..... 114/16 R; 61/69 R

[51] Int. Cl.[2] ..... B63G 8/00

[58] Field of Search ..... 114/16 R, 235 B, 244; 61/69 R

[56] References Cited

UNITED STATES PATENTS

| | | | |
|---|---|---|---|
| 2,981,073 | 4/1961 | Robinson | 114/16 R |
| 2,987,893 | 6/1961 | Robinson | 114/16 R |

*Primary Examiner*—Trygve M. Blix
*Assistant Examiner*—Charles E. Frankfort
*Attorney, Agent, or Firm*—Cushman, Darby & Cushman

[57] ABSTRACT

A submersible vehicle connectable to a parent surface vessel by an umbilical cable link has an anchorage for that cable link arranged such that the resultant is maneuvered can pass through the center of drag of the vehicle when it is submersed. Accordingly control of the submersible vehicle is facilitated because no excessive disturbing moments are passed to the vehicle by the cable.

4 Claims, 5 Drawing Figures

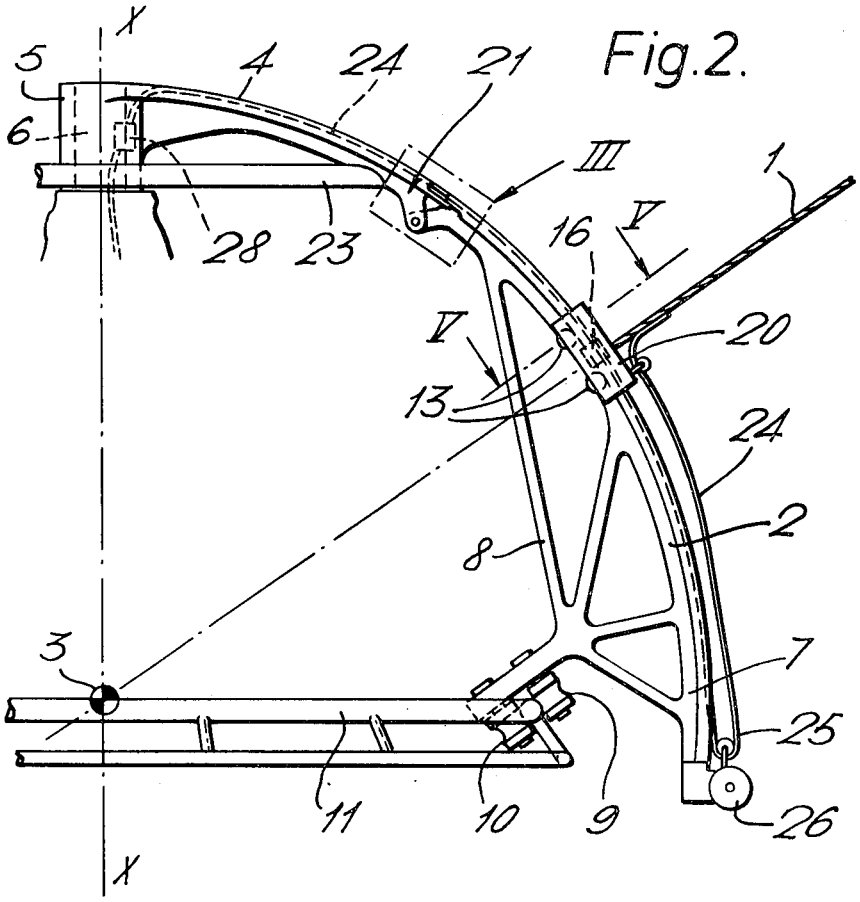
Fig.2.
Fig.3.
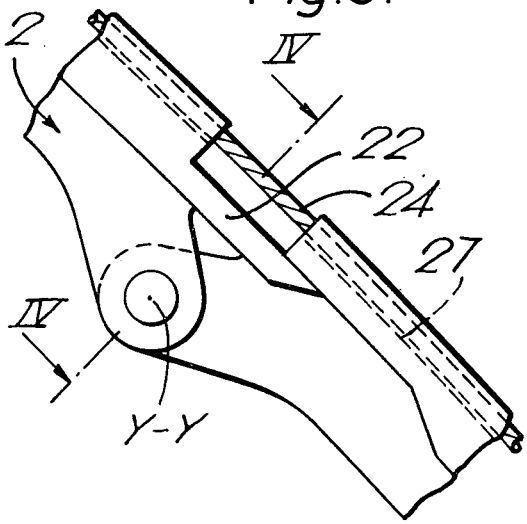
Fig.4.
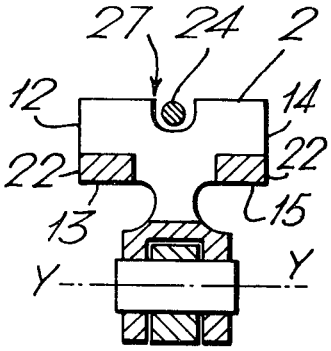

VEHICLES OF THE SUBMERSIBLE TYPE

This invention relates to submersible vehicles of the type having a cable link to a surface vessel through which remote control of the submersible vehicle is effected.

In such a vehicle control can be made difficult due to excessive disturbing moments applied to the vehicle by tension loads in the cable during manoevring. An object of the invention is to facilitate control by reducing these disturbing moments to an acceptable level.

According to the present invention, a submersible vehicle has an anchorage means for a cable link, the anchorage means including an arcuate trackway, lying within a plane including an axis passing through the centre of drag of the vehicle when submersed, and describing an arc centred upon the said centre of drag, first and second locating means respectively locating spaced regions of the said arcuate trackway on the vehicle, said locating means allowing bodily rotation of the arcuate trackway about said axis, and trolley means, constrained to move along the arcuate trackway, to which a cable link is attachable, the arrangement being such that the arcuate trackway can rotate about said axis and the trolley means can move along the arcuate track under the effect of a tension load in the cable link when attached so that the resultant axis through which this load acts can pass through the centre of drag of the vehicle.

Preferably the arcuate trackway describes an arc of at least 90° so that the cable link can extend from the vehicle vertically, horizontally, or at any angle in between.

A preferred embodiment of the invention is described with reference to the accompanying drawings.

In these drawings:

FIG. 2 is an enlarged view of the cable link anchorage means,

FIG. 3 is an enlarged side view of the region in the box III of FIG. 2,

FIG. 4 is a cross-sectional view taken upon lines IV—IV of FIG. 3, and

Figure 1:
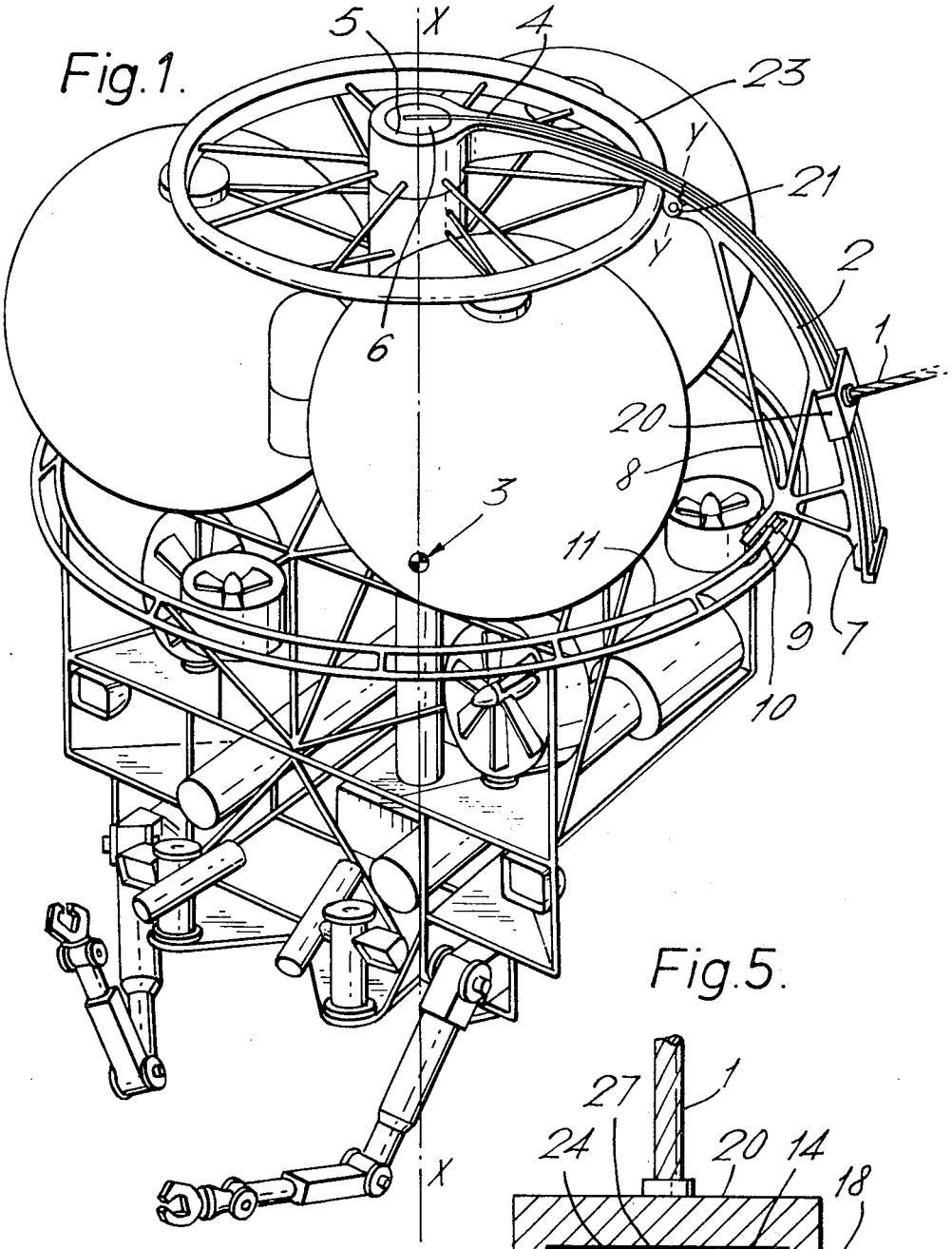
FIG. 1 is a perspective view of an un-manned submersible vehicle.

In the drawings, which are views of an un-manned submersible vehicle, an umbilical cable 1 extends from the submersible vehicle to a surface vessel (not shown). Through the cable 1 control signals are passed from the surface vessel to steer the submersible vehicle and to operate its equipment. The cable is also used to draw the vehicle up out of the water.

An anchorage means is provided on the vehicle to anchor the umbilical cable. This comprises an arcuate trackway 2 which lies within a plane including an axis X—X which axis passes through the centre of drag 3 of the vehicle. The centre of drag of the vehicle is that point where the drag of the vehicle (due to its passage through water) effectively acts when it is submersed.

The arcuate track has an upper end 4 (as drawn) which is connected to an annular hub member 5 which, in turn, fits over an axle member 6. The axle member 6 is rigidly mounted on the vehicle co-axially with the axis X—X; the hub member 5 and hence the arcuate track rotate with respect to the axle member 6. The members 5 and 6 provide the said first locating means.

The arcuate track further has a lower end 7 which is connected by means of a framework 8 and spaced rollers 9 and 10 to an annular guideway 11 which extends around and is mounted upon the vehicle co-axially with the axis X—X. The lower end 7 of the arcuate track is thus constrained to follow the guideway. The items 9, 10 and 11 form the said second locating means.

Figure 5:
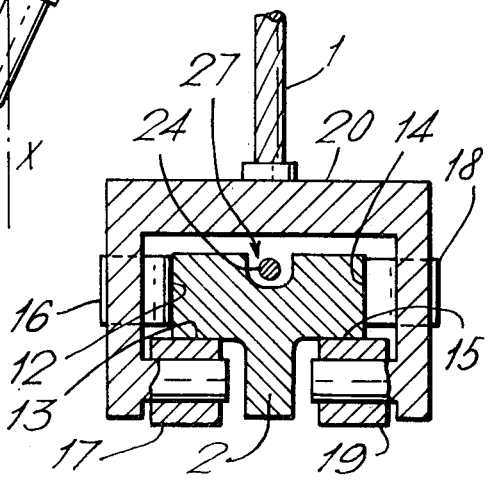
FIG. 5 is an enlarged cross-sectional view taken upon lines V—V of FIG. 2.

As illustrated in FIG. 5, the trackway 2 is of T-shape in cross-section, and has four track surfaces 12, 13, 14 and 15 formed upon it. These are engaged by rollers 16, 17, 18 and 19, respectively, on which is carried a trolley member 20. The trolley 20 is free to move along the length of the trackway 2; it is adapted to be attached to the umbilical cable 1.

The arcuate trackway 2 is formed in two pieces with a hinge 21 in between. The track surfaces 12, 13, 14, and 15 remain unbroken by the hinge, since overlapping portions 22 are provided as illustrated in FIGS. 3 and 4. To ensure that the tracks remain unobstructed the axis Y—Y of the hinge is offset towards the interior of the vehicle. The hinge axis Y—Y lies transverse to the trackway such that the radius of curvature thereof can, in effect, be slightly increased or decreased to compensate for any irregularities in the curvature of the guideway 11. Such irregularities can be caused by assembly errors or by damage subsequently.

The arcuate track 2 is of such a length as to form an included angle of rather more than 90°, the trackway extending over the axle 6 so that the cable 1 can be truly vertical (i.e. in line with the axis X—X) and the vehicle accordingly lifted out of the water by the cable.

The upper portion of the arcuate track, that is to say that portion above the hinge 21, is stabilised by a wheel-like member 23.

Since the umbilical cable 1 provides a control link for the submersible vehicle, means are provided to effect an electrical connection from the umbilical to the vehicle irrespective of the position of the trolley member 20. This is achieved by extending an electrical cable 24 from the umbilical cable 1 in a loop 25 to a tensioning device 26 mounted upon the lower end 7 of the trackway 2, the electrical cable then extending from the region of tensioning device 26 along a channel 27 in the trackway 2 into the hub member 5. The electrical signals are then passed by means of a slip ring arrangement 28 (not shown in detail but of known design) into the axle and from thence into the vehicle itself.

In use, the submersible vehicle can move through a radius of action below the surface vessel as constrained by its umbilical cable. As the vehicle is manoevred the cable trails rearwardly and generally upwards, the tensile forces in the cable drawing the trolley member along the arcuate track 2 in accordance with the local angle of the cable with respect to the vehicle. Similarly, the cable draws the arcuate trackway 2 bodily around the vehicle.

Since the resultant axis of the tension force in the umbilical cable can always pass through the centre of drag of the vehicle, control of the vehicle is improved because no excessive disturbing moments are passed to the vehicle by the cable.

We claim:

1. A submersible vehicle having anchorage means for a cable link the anchorage means including, an arcuate trackway formed in two pieces lying generally end-to-end within a plane including an axis passing through the centre of drag of the vehicle when submersed, and together describing an arc centred upon the said centre of drag, first and second locating means respectively locating the two pieces of the arcuate trackway on the vehicle, said locating means allowing bodily rotation of the arcuate trackway about said axis, hinge means for hinging the two pieces together, and trolley means, constrained to move along the arcuate trackway, to which a cable link is attachable, the arrangement being such that the arcuate trackway can rotate bodily about said axis, the trolley means can move along the arcuate trackway under the effect of a tension load in the cable link so that the resultant axis through which this load acts can pass through the centre of drag of the vehicle, and the two pieces of trackway can pivot with respect to each other to accommodate any irregularities in the locating means.

2. A submersible vehicle according to claim 1 wherein the arcuate trackway describes an arc of at least 90° so that the cable link can extend from the vehicle vertically, horizontally, or at any angle in between.

3. A submersible vehicle according to claim 2 wherein the first locating means comprises an axle member mounted coaxially with the said axis on the vehicle and a hub member, one of said pieces of the arcuate trackway being rotatable mounted on the axle member.

4. A submersible vehicle according to claim 3 wherein the second locating means comprises an annular guide means mounted upon and extending around the vehicle coaxially with said axis, and a constraining means constraining the other piece of said pieces of the arcuate track to follow said annular guide means when moved.

* * * * *